US005377870A

United States Patent [19]

Morel

[11] Patent Number: 5,377,870

[45] Date of Patent: Jan. 3, 1995

[54] AXIALLY SLIDABLE DISPENSING CLOSURE CAP

[75] Inventor: Simone Morel, Montmirail, France

[73] Assignee: Societe de Conseils Et d'Etude des Emballes (S.C.E.E.), Societe Anonyme, Soisy sous Montmorency, France

[21] Appl. No.: 51,202

[22] Filed: Apr. 22, 1993

[30] Foreign Application Priority Data

Apr. 23, 1992 [FR] France ..... 92 05017

[51] Int. Cl.[6] ..... B56D 3/00

[52] U.S. Cl. ..... 222/23; 222/39; 222/153; 222/499; 222/522; 222/532

[58] Field of Search ..... 222/23, 39, 153, 499, 222/522, 523, 524, 531, 532, 537

[56] References Cited

U.S. PATENT DOCUMENTS

| | | | |
|---|---|---|---|
| 2,877,918 | 3/1959 | Gardner | 222/522 X |
| 4,272,228 | 6/1981 | Kutik et al. | 222/531 X |
| 4,620,646 | 11/1986 | Crapser | 222/153 |
| 4,779,774 | 10/1988 | Morel | 222/522 |
| 4,982,882 | 1/1991 | Gueret | 222/531 |
| 5,094,361 | 3/1992 | Dubach | 222/524 X |
| 5,100,033 | 3/1992 | Cho | 222/523 |
| 5,230,447 | 7/1993 | Kirk | 222/524 |

FOREIGN PATENT DOCUMENTS

| | | | |
|---|---|---|---|
| 0081397 | 6/1983 | European Pat. Off. | 222/153 |
| 265567 | 5/1988 | European Pat. Off. . | |
| 2563191 | 10/1985 | France . | |
| 2627461 | 8/1989 | France | 222/522 |
| 3512609 | 10/1986 | Germany . | |

*Primary Examiner*—Andres Kashnikow
*Assistant Examiner*—Kenneth Bomberg
*Attorney, Agent, or Firm*—Sandler Greenblum & Bernstein

[57] ABSTRACT

A dispenser capsule for liquid or paste products comprising an element sliding in a tubular envelope between an open raised position and a closed retracted position, via a maneuvering thruster for respectively disengaging or blocking a flow opening of the product contained in the receptacle on which the capsule is mounted. The capsule comprises a cowl which is adapted to be mounted on the neck of the receptacle and which is affixed to the envelope in which is slidably mounted a piston guided axially by the envelope and by a chimney also affixed to cowl, the chimney communicating by one end with the opening of neck of the receptacle, its other end having an opening which is reduced with respect to that of the neck and in communication with said flow opening when piston is in a raised open position. The piston comprises a top and a lateral wall forming the maneuvering thruster and wherein the envelope is provided with a recessed portion enabling access to the thruster for its activation.

20 Claims, 3 Drawing Sheets

AXIALLY SLIDABLE DISPENSING CLOSURE CAP

BACKGROUND OF THE INVENTION

1. Field of the Invention

The present invention is related to dispenser capsules for liquid, paste or cream products. The dispenser capsules are used with receptacles such as tubes or vials, and comprise a cowl which remains affixed to the receptacle in the open and closed positions of the capsule.

2. Discussion of the Background Information

A capsule of this type has been described in EP 0265567, the entire disclosure of which is hereby incorporated by reference, which shows a dispenser capsule for liquid or paste products comprising an element sliding in a tubular envelope between an open raised position and a closed retracted position, by means of a maneuvering thruster so as to respectively disengage or block a flow opening of the product contained in a receptacle on which the capsule is mounted.

The invention is especially related to an improvement of such a capsule.

SUMMARY OF THE INVENTION

In particular, the invention enables the arrangement of two successive sealing elements, in such a way that the capsule, as per the invention, can be used for particularly volatile products, such as alcohol.

In addition, as per the invention, the pressure formed in the receptacle is only applied on a limited surface of the mobile portion of the capsule in such a way that the reduced force resulting from it is insufficient to cause a displacement of the mobile portion, which prevents any risk of accidental opening of the capsule.

It is therefore possible to eliminate all excessive tightening of the mobile portion in the envelope, resulting thereby in remarkable ease of use.

The capsule comprises a tubular envelope including a recessed portion; an element slidably inserted within the tubular envelope the element comprising; a cowl affixed to the envelope and adapted to be assembled on the neck of a receptacle; a flow opening; a piston slidably mounted in and axially guided by the tubular envelope between a closed, retracted position wherein said flow opening is blocked, and an open, raised positioned wherein said flow opening permits flow of material, the piston including a top and a lateral wall, and one portion of the lateral wall comprising a maneuvering thruster across from the recessed portion; and a chimney affixed to the cowl, the chimney including two ends, one of the two ends adapted to communicate with the neck of the receptacle and the other of the two ends comprising a reduced opening in communication with the flow opening when the piston is in a raised, open position.

Advantageously, the piston comprises a sealing skirt external to the chimney and extending from a portion of internal wall of the top of the piston and which extends inwardly against the first external wall of the chimney.

According to one embodiment, the internal wall of the top of the piston comprises a sealing skirt internal to the chimney, coaxial to the external sealing skirt, and defining a plug for the chimney when introduced therein in the closed position. According to a further embodiment, the longitudinal axis of the chimney is offset, at least in its upper portion with respect to the longitudinal axis of the cowl.

According to another embodiment, the dispenser capsule further comprises a space between the cowl and the envelope, and the maneuvering thruster comprises a tongue including an internal wall, capable of sliding into the space.

The flow opening is defined by a conduit lateral in the piston and extending, in the closed position of the piston, between the internal wall of the envelope and the second external wall of the chimney. The conduit may be inclined downwardly and inwardly.

In one additional embodiment of the invention, the cowl is affixed to the neck of the receptacle and the recessed portion of the envelope enabling access to the thruster, is temporarily masked by a protective tongue which is easily detachable, preventing any maneuvering of the thruster without previous detachment from the tongue. Thus, the device is guaranteed to be tamperproof.

In an additional embodiment, the dispenser capsule comprises projections arranged respectively on the internal wall of the tongue and in the conduit adapted to limit the sliding of the piston. Additionally, the envelope further comprises an internal wall and the tongue further comprises two recesses defining a bar adapted to cooperate with a projection on the internal wall of the envelope to ensure an elastic latching in the closed position.

In a still additional embodiment, the cowl is connected to the envelope by an annular bearing adapted to be supported on the receptacle, and the cowl further comprises a skirt adapted to be introduced into the neck of the receptacle.

In a further embodiment, the piston further comprises, a hollow above the conduit adapted to indicate the point of flow of the product and an inclined cant above the maneuvering thruster and adapted to facilitate the tearing away of the protective tongue. The piston additionally comprises at least one guide skirt extending from the internal wall of the top of the piston, and the cowl further comprises a projection having a complementary shape of the guide skirt, extending inwardly and adapted to cooperate with the projection.

In a still further embodiment, the dispenser capsule comprises at least one guide, affixed to the cowl, extending coaxially with respect to the internal wall of the piston and a rib projecting outwardly beneath the recessed portion of the envelope.

In an additional embodiment, the cowl further comprises an internal face including at least one longitudinal rib and the neck comprises a groove having a V shaped opening and a lower recessed portion wherein the longitudinal rib is adapted to cooperate with the lower recessed portion.

BRIEF DESCRIPTION OF THE DRAWINGS

The invention will be better understood and other characteristics will become clearer upon reading the description that follows with references to the annexed drawings, in which.

DETAILED DESCRIPTION OF THE PREFERRED EMBODIMENTS

Figure 1:
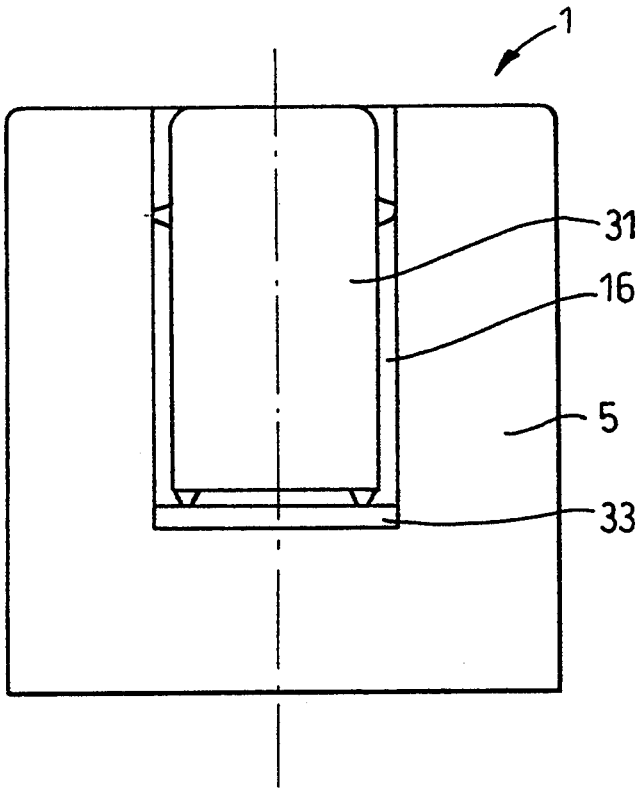
FIG. 1 is a planar view of a capsule according to the invention.
Figure 2:
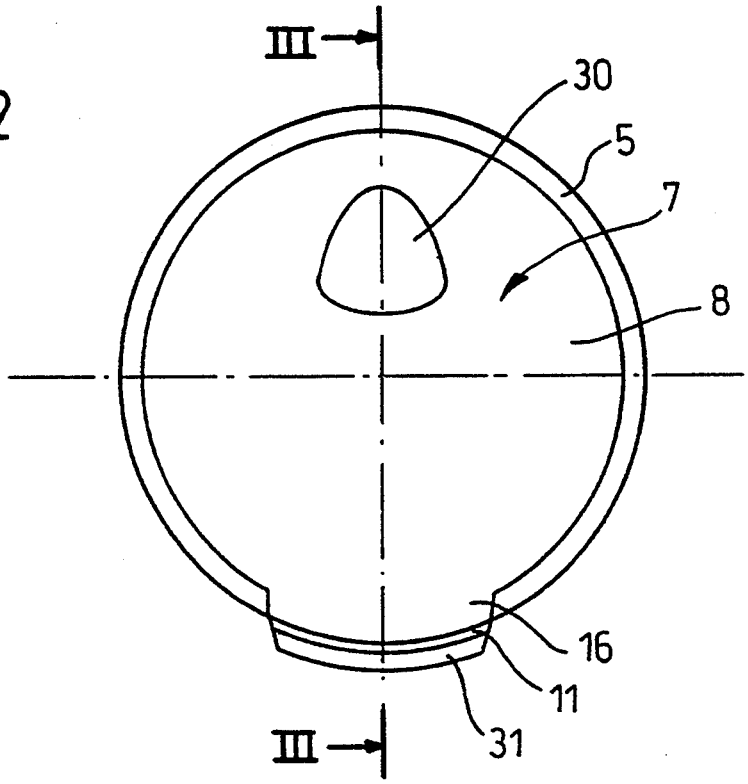
FIG. 2 is a top view of the capsule of FIG. 1.

Although the drawings show two very similar embodiments, the elements that are similar and/or have the same function bear the same references numerals for reasons of clarity.

A capsule in accordance with the invention, designated generally by the reference numeral 1, is adapted to be fixed on a receptacle 2 (FIGS. 3 and 5 to 7) including a vial, or a flexible tube, or other, as per the nature of the product contained which can be liquid, paste, or cream.

The receptacle 2 comprises an opening demarcated by a neck 3 on which the capsule is force fit or screwed.

As can be seen in the drawings, capsule 1 is constituted of only two elements located one inside the other. The elements can be made by molding a synthetic material.

One of the elements forms a cowl 4 adapted to be fixed on neck 3 and is affixed to an external cylindrical envelope 5 and to a chimney 6 which extends across from neck 3 and whose open end turned towards the neck 3 communicates with the opening thereof. The other end of the chimney has an opening 24 described hereinafter, whose diameter is smaller than that of the opening of neck 3.

The second element constitutes a piston 7 provided with a top 8 and a lateral wall 9.

Piston 7 is slidably mounted with slight rubbing in envelope 5 whereas the internal wall of its top 8 is provided with a skirt 10 which extends inwardly and which takes support on the external wall of chimney 6, the piston also being guided by envelope 5 of the chimney 6.

Figure 4:
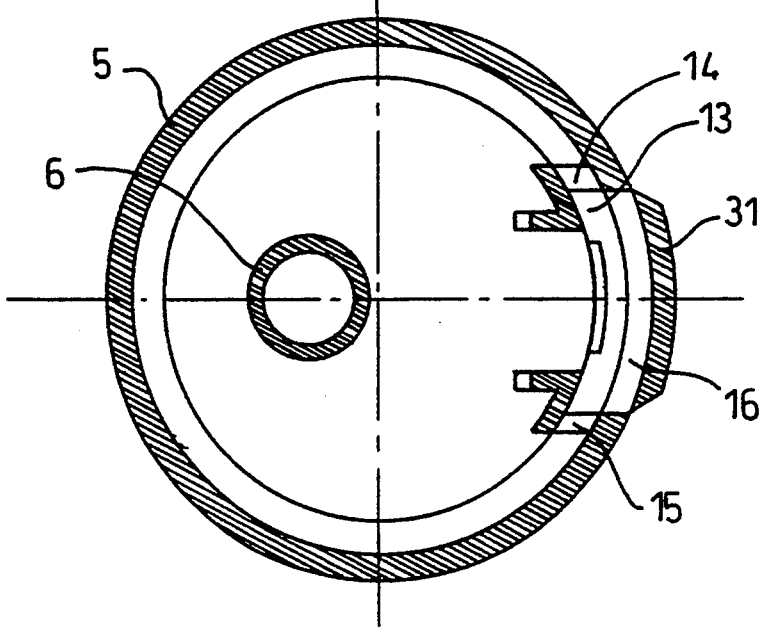
FIG. 4 is a section along IV—IV of FIG. 3, without the element forming the piston.

The lateral wall 9 of piston 6 comprises a portion forming a thruster 11 which is provided with transverse ribs 40 or other surface roughnesses to facilitate its activation and comprises a tongue 12 demarcated by longitudinal slits, the tongue sliding in a space 13 which is arranged between cowl 4 and envelope 5 and which is, in addition, demarcated laterally by walls 14, 15 (FIG. 4).

Figure 7:
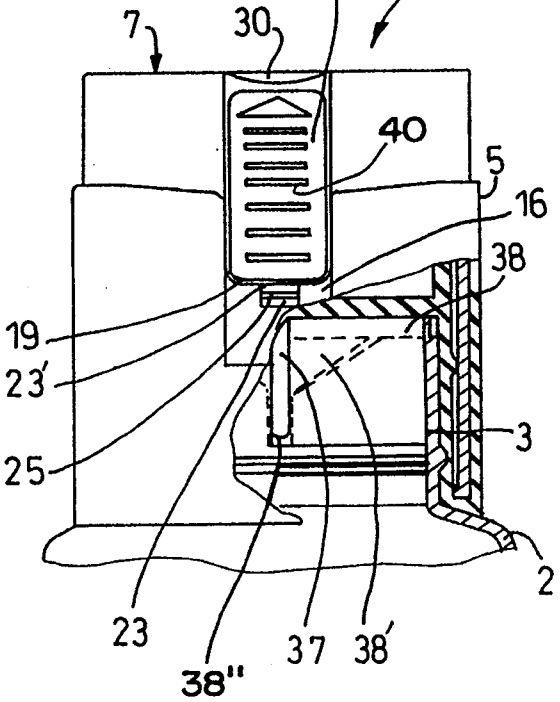
FIG. 7 is a side view, partially exposed, of the capsule according to the embodiment of FIGS. 5 and 6, in an open position, the protective tongue being withdrawn.

To have access to thruster 11, envelope 5 comprises a recessed portion 16 more particularly visible in FIGS. 1 and 7, which extends from the upper portion of the envelope and which has a contour whose projection along a plane has the shape of a U.

It is understood that thruster 11 slides with piston 7 in envelope 5 without projecting therefrom.

The sliding of piston 7 is, for example, limited in the direction of the raising by the cooperation of projections 17, 18 respectively arranged on the external wall of cowl 4 and the internal wall of tongue 12, whereas in the inverse direction, a shoulder 19 of thruster 11 takes support on the base of recessed portion 16 of envelope 5.

The axis of chimney 6, or at least its end, can be offset with respect to the axis of neck 3 as in the embodiments represented.

Piston 7 is provided with an opening 20 which is arranged in its lateral wall 9.

Figure 3:
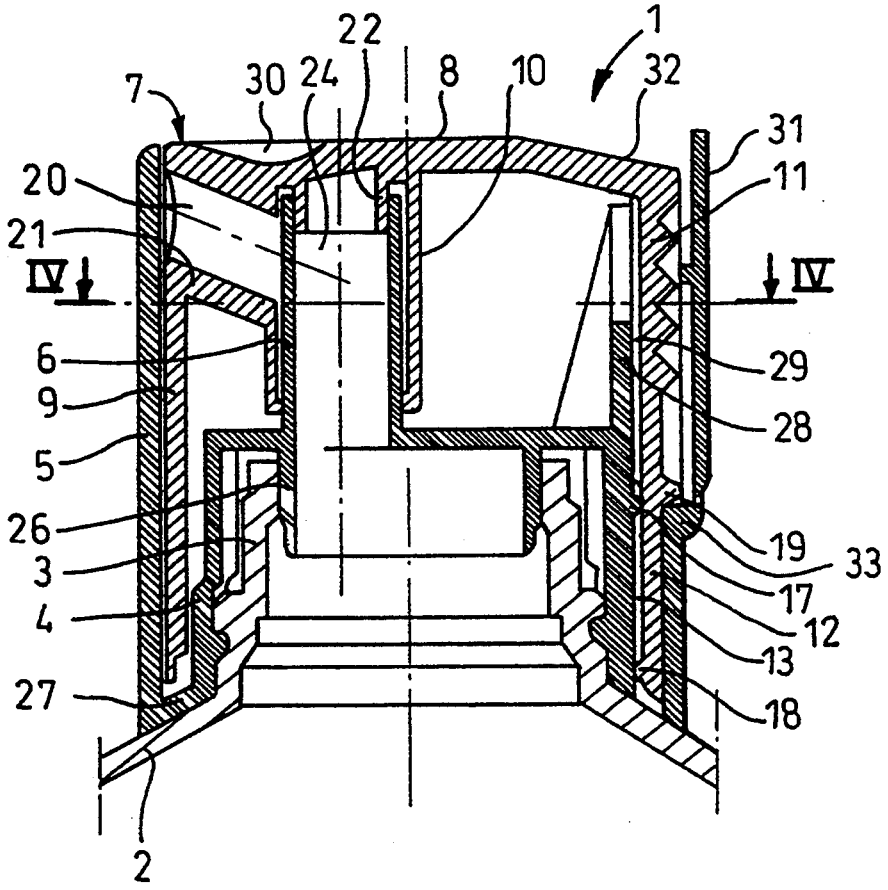
FIG. 3 is a section along III—III of FIG. 2, of the capsule located on a receptacle.
Figure 6:
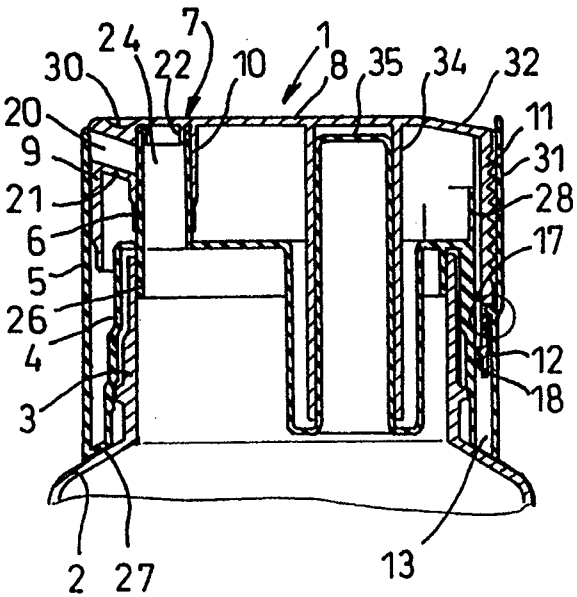
FIGS. 5 and 6 show, in an axial section, another embodiment provided with small variations, respectively, in the open and closed positions.

Opening 20 is demarcated by a conduit 21 inclined inwardly and downwardly by extending, in the position shown in FIGS. 3 and 6, between the internal wall of envelope 5 and the external wall of chimney 6.

Figure 5:
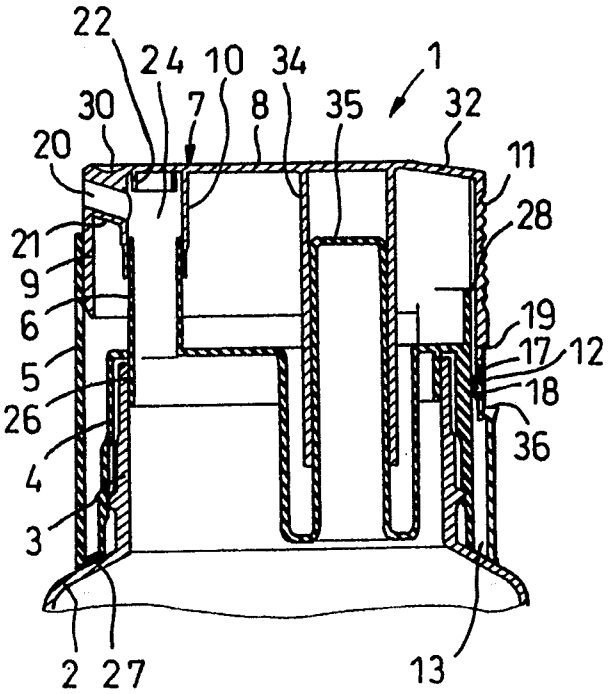

FIGS. 1, 3 and 6 show a capsule as per the invention in the closed position which corresponds to the extreme retracted position of piston 7 in envelope 5, whereas FIGS. 5 and 7 show a capsule in an open position.

In the embodiments represented, conduit 21 is blocked by envelope 5 and by chimney 6, which is itself blocked by an internal skirt 22, coaxial to skirt 10 which projects from the internal wall of top 8 of piston 7 and which is introduced in the upper opening 24 of the chimney 6. Chimney 6 thus forms a blocking valve of the guillotine type.

In the embodiment of FIGS. 5 to 7, it should be noted that tongue 12 is provided with two recesses 23, 23' leaving therebetween a small bar 25 (more particularly visible in FIG. 7).

Figure 6A:
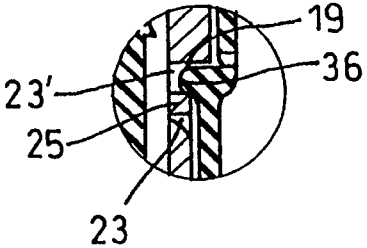
FIG. 6A is an enlarged view of the elastic latching mechanism shown in FIG. 6.

Bar 25 is especially adapted to elastically latch the closed position (FIG. 6A) by passing beneath a small projection 36 arranged on the internal surface of envelope 5. It is understood that the unlatching is undertaken by a simple application of force, by virtue of the elasticity of the material.

The materials are chosen to constitute just one rigid point and advantageously create, in passing, a small noise obtaining thereby an audible signal of position.

Besides, cowl 4 comprises, across from chimney 6, a skirt 26 which is introduced in a sealed fashion in neck 3 of the receptacle.

As already stated, cowl 4 can be screwed on neck 3, the cowl being threaded and the neck having threads, but it is possible to fix, in a non-detachable manner, the cowl on neck 3, for example, by force fitting.

Whatever the fixing mode, cowl 4 can rest on a shoulder of receptacle 2, as can be seen in the drawings, by an annular bearing 27 which connects the cowl 4 to envelope 5.

To obtain opening of the capsule, one need only raise piston 7 by acting on thruster 11 in such a way that the product contained in recipient 2 can be poured or brought under pressure (by pressing, for example, on the receptacle which can be flexible to this end) by opening 20, by passing first through opening 24 of chimney 6 and conduit 21. It is understood that skirt 10 ensures the seal with chimney 6, by providing at least a rubbing or scraping ring on one of the elements. It is understood that the raising of piston 7 opens the ends of conduit 21, the ends being located above envelope 5 and chimney 6 respectively (FIG. 5).

To come back to the closed position, piston 7 must naturally be pressed by means of thruster 11 or pressure must be applied directly on the top of the piston.

It is understood that opening 24 of chimney 6 on the side of opening 20 is reduced due to the fact that a smaller diameter with respect to that of the neck is adopted. The reduced diameter of the end of chimney 6 can derive from a constant reduced diameter as represented, or from a shrinking and/or partial blocking as per non-represented variations. The opening 24 of the chimney is blocked (in the closed position) by a limited portion of the top of piston 7 in such a way that the surface of the latter, which is subject to the pressure present in the receptacle, is particularly reduced. This prevents an accidental opening of the capsule by a non-desired sliding.

In addition, the drawings also show longitudinal guides 28 which project from cowl 4 across from neck 3 and which may cooperate with grooves or ribs such as 29 (FIG. 3) of the piston.

Instead of ribs 28, or in addition thereto, one can provide, as in the embodiment of FIGS. 5–7, a guide skirt 34, formed from the internal wall of top 8 of piston 7 and extending inwardly. The guide skirt 34 is adapted to cooperate with a projection 35 having a complementary shape provided on cowl 4.

The guide skirt 34 is especially adapted to the embodiment of FIGS. 5–7 for which the ratio of the height of the capsule with respect to its diameter is smaller than that of the other drawings.

FIGS. 2, 3 and 5–7 also show that the top 8 of piston 7 bears a hollow 30 which is used both to indicate the point of flow opening 20 and to prevent folds in the plastic after molding.

In the embodiments represented, the capsule is initially latched, recessed portion 16 of the envelope 5 being masked by a protective tongue 31, (FIGS. 1, 3 and 6) which prevents any manipulation of thruster 11 before destruction of the tongue 31 which is fixed less solidly to envelope 5, for example by breakage hooks.

In this way, tongue 31 constitutes a guarantee of the tamper-proof nature of the device, piston 7 in the closed position reaching the level of envelope 5 and therefore not offering any other activation means.

To facilitate tearing away of tongue 31, top 8 of piston 7 can advantageously comprise an inclined cant 32.

To ensure a correct angular positioning of the capsule in the assembly machine, the capsule, can be provided with an orientation and indicator means such as rib 33 (FIGS. 1 and 3) arranged at the border of the base of recessed portion 16. Rib 33 also enables, by virtue of its positioning, tongue 31 to be protected against an accidental tearing away.

FIG. 7 with partial tear, shows that the internal face of cowl 4 comprises at least one longitudinal rib 37 arranged across from thruster 11. Rib 37 is adapted to cooperate with a groove 38' provided with a lower recessed portion 38" having a V shaped opening, which are arranged in the thickness of neck 3 of receptacle 2.

In this way, the capsule is positioned by rotation on neck 3 up until rib 37 falls into lower recessed portion 38", thus ensuring a positioning and/or angular blockage of the capsule on the receptacle. This is useful for a receptacle having an oval or elliptical section, but also for a receptacle which is circular. The fixing of the capsule is, in addition by force or with one or more appropriate ribs.

In addition to the advantages already cited, it is understood that the inclination of conduit 21 in FIG. 3 enables a better recovery of the product by gravity and suction, the recovery being facilitated even more due to the fact that the length of the conduit is reduced by virtue of the offset of chimney 6.

The use, both easy and simple of the device, and the good seal provided by a capsule as per the invention enables it to be envisioned for use on multiple applications, with the knowledge that the receptacle can be of any type and the envelope is also capable of having diverse shapes.

It must also be noted that if tongue 12, by forming a key in conduit 13, prevents any rotation of the piston with respect to the envelope, this rotation also is prevented due to the offset and/or non-symmetry of certain elements and especially of the chimney.

This application is related to French Application No. 92 05017, filed Apr. 23, 1992, priority of which is claimed, whose disclosure is hereby incorporated by reference thereto in its entirety.

Finally, it is clear that the embodiments described are not the only ones that can be envisioned as regards the claims. The inventor has also envisioned other embodiments, not described, such as, having for example an opening at the top of the piston, blockable by a cork arranged on the chimney.

What is claimed:

1. A dispenser capsule for material including liquid, paste or cream products comprising:

a tubular envelope including an internal wall and a recessed portion;

a cowl affixed to said envelope and adapted to be assembled on a neck of a receptacle;

a chimney affixed to said cowl, said chimney including two ends, one of said two ends adapted to communicate with the neck of the receptacle and said other of said two ends comprising a reduced opening;

a piston including a flow passage, said piston being slidably mounted in and axially guided by said tubular envelope and said chimney between a closed, retracted position wherein said flow passage is blocked, and an open, raised positioned wherein said reduced opening of said chimney is in communication with said flow passage opening to permit flow of material, said piston including a top and a lateral wall, and one portion of said lateral wall comprising a maneuvering thruster within said recessed portion;

said top of said piston includes an internal wall and said chimney includes an external wall, said piston further comprising a sealing skirt external to said chimney and extending from said internal wall of said top of said piston inwardly against said external wall of said chimney; and said flow passage comprises a conduit laterally positioned in said piston, said conduit extending, in the closed position of said piston, between said internal wall of said envelope and said external wall of said chimney.

2. The dispenser capsule as defined by claim 1 comprising at least one guide skirt extending from said internal wall of said top of said piston, and said cowl further comprises a projection having a complementary shape of said at least one guide skirt, extending into said at least one guide skirt.

3. The dispenser capsule as defined by claim 1, wherein said internal wall of said top portion of said piston further comprises a sealing skirt internal to said chimney, coaxial to said external sealing skirt, and defining a plug for said chimney when introduced therein in the closed position.

4. The dispenser capsule as defined by claim 1, wherein said chimney has a longitudinal axis, and the longitudinal axis of said chimney is offset, at least in its upper portion, with respect to a longitudinal axis of said cowl.

5. The dispenser capsule as defined by claim 1, further comprising a space between said cowl and said envelope and said maneuvering thruster further comprises a tongue capable of sliding into said space.

6. The dispenser capsule as defined by claim 5, wherein said tongue further comprises an internal wall, and the sliding of said piston is limited by projections arranged respectively on said internal wall of said tongue and in said space.

7. The dispenser capsule as defined by claim 5, wherein said tongue further comprises two recesses defining a bar adapted to cooperate with a projection on said internal wall of said envelope to ensure an elastic latching in the closed position.

8. The dispenser capsule as defined by claim 1, wherein said cowl is connected to said envelope by an annular bearing adapted to be supported on the receptacle, and said cowl further comprises a skirt adapted to be introduced into the neck of the receptacle.

9. The dispenser capsule as defined by claim 1, said envelope further comprising a rib projecting outwardly beneath said recessed portion of said envelope.

10. The dispenser capsule as defined by claim 1, wherein said conduit is inclined downwardly and inwardly.

11. The dispenser capsule as defined by claim 1, wherein said top of said piston further comprises a hollow above said conduit adapted to indicate the point of flow of the product.

12. The dispenser capsule as defined by claim 1, wherein said recessed portion is masked by a detachable, protective tongue.

13. The dispenser capsule as defined by claim 12, wherein said top of said piston comprises an inclined cant above said maneuvering thruster and adapted to facilitate tearing away of said protective tongue.

14. The dispenser capsule as defined by claim 1, further comprising at least one guide, affixed to said cowl, extending coaxially with respect to a longitudinal axis of said piston.

15. In combination, the dispenser capsule of claim 1 attached to a receptacle, for liquid, paste or cream products, comprising a container including a neck, the cowl being attached to said neck.

16. The combination as defined by claim 15, wherein said cowl further comprises an internal face including at least one longitudinal rib and said neck comprises a groove having a V shaped opening and a lower recessed portion, wherein said longitudinal rib is adapted to cooperate with said lower recessed portion.

17. The combination as defined by claim 15, comprising a tube.

18. The combination as defined by claim 17, wherein said tube is flexible.

19. The combination as defined by claim 15, comprising a vial.

20. The combination as defined by claim 19, wherein said vial is flexible.

* * * * *